US006283250B1

(12) United States Patent
Asher

(10) Patent No.: US 6,283,250 B1
(45) Date of Patent: Sep. 4, 2001

(54) PORTABLE AND ADJUSTABLE WORKBENCH

(76) Inventor: Samuel M. Asher, 1347 Golden Ave., Eugene, OR (US) 97404-2875

( * ) Notice: Subject to any disclaimer, the term of this patent is extended or adjusted under 35 U.S.C. 154(b) by 0 days.

(21) Appl. No.: 09/422,221

(22) Filed: Oct. 21, 1999

Related U.S. Application Data

(60) Provisional application No. 60/104,620, filed on Oct. 16, 1998.

(51) Int. Cl.[7] ..... E04G 1/34; E04G 1/00

(52) U.S. Cl. ..... 182/153; 182/181.1; 182/225

(58) Field of Search ..... 182/181.1, 182.4, 182/182.5, 186.4, 224, 153, 225

(56) References Cited

U.S. PATENT DOCUMENTS

| | | | | |
|---|---|---|---|---|
| 1,103,699 | * | 7/1914 | South | 182/153 X |
| 1,147,522 | | 7/1915 | Loomis . | |
| 1,226,112 | * | 5/1917 | Pepin | 182/153 |
| 1,566,171 | * | 12/1925 | Spurr | 182/181.1 X |
| 4,375,245 | * | 3/1983 | Schill | 182/155 |
| 4,596,308 | * | 6/1986 | Auerbach | 182/151 X |
| 4,756,384 | * | 7/1988 | Maddox | 182/182.5 X |
| 4,782,917 | * | 11/1988 | Schulz | 182/182.5 X |
| 4,877,109 | | 10/1989 | Welch et al. . | |
| 5,007,502 | | 4/1991 | Shapiro . | |
| 5,141,077 | * | 8/1992 | Zuercher | 182/224 |
| 5,265,697 | * | 11/1993 | Quick | 182/181.1 |
| 5,351,785 | * | 10/1994 | Du Rapau | 182/153 |
| 5,904,225 | * | 5/1999 | Patros | 182/181.1 |

OTHER PUBLICATIONS

Odate, Toshio; from "Japanese Woodworking Tools: Their Tradition . . . "; 1984; Ch. 1, pp. 6 & 7.

Crawford Products, Inc.; product brochure for their #90 "Double Duty" Sawhorse brackets.

* cited by examiner

*Primary Examiner*—Daniel P. Stodola
*Assistant Examiner*—Hugh B. Thompson

(57) ABSTRACT

A workbench for use with a workpiece includes a work surface having multiple slots therethrough for securing the workpiece thereto; a pair of spaced apart frames attached to the work surface, wherein each frame includes a pair of legs and a brace structure; wherein the legs each have a groove extending along the length thereof, and which further includes a leg extension adjustably received in the groove for individually and infinitely adjusting the length of each leg.

9 Claims, 5 Drawing Sheets

PORTABLE AND ADJUSTABLE WORKBENCH

RELATED APPLICATIONS

This application claims priority from United States of America Provisional Patent Application Ser. No. 60/104,620, filed Oct. 16, 1998 for PORTABLE AND ADJUSTABLE WORKBENCH.

FIELD OF THE INVENTION

This invention relates to portable workpiece supports, and specifically to a portable workbench that is capable of holding a variety of work pieces thereto using conventional workpiece fixing instrumentalities.

BACKGROUND OF THE INVENTION

A number of portable workbenches are known. Perhaps one of the most well known portable workbenches is that manufactured by Black and Decker, Inc. under the Workmate® trademark. While such known workbenches are suitable for their intended purposes, they have certain shortcomings that are addressed by the workbench of the invention.

A simple planing beam has been used by oriental craftsmen for centuries. This device incorporates a triangular support at one end thereof, and allows the workpiece to rest on the floor or ground at the other end thereof. Because a three-point support will always conform to the grounding surface, problems of leveling are not present with this form of workbench.

A workbench is intended to provide a working surface for a task. Frequently, this requires that a workpiece be secured to the working surface of a workbench. Although a number of attachment schemes are known, such schemes generally incorporate fixed attachment points, and only allow for attachment of a workpiece to the upper surface of the workbench by a predetermined fixation method, such as clamps or dogs which are provided with the workbench.

U.S. Pat. No. 1,147,522, granted Jul. 20, 1915 to Loomis describes an adjustable workbench wherein one set ground-contacting legs rides on another set of legs which support a cross-piece, allowing the workbench to be adjusted for height and uneven surfaces.

U.S. Pat. No. 4,877,109, granted Oct. 31, 1989 to Welch et al. describes and adjustable sawhorse having a set of fixed, hollow legs and a set of adjustable legs which are received in the hollow legs, and are moveable at fixed increments.

U.S. Pat. No. 5,007,502, granted Apr. 16, 1991 to Shapiro describes a self-leveling saw horse wherein the leg length is fixed and the cross-piece is adjustable to remain parallel to the supporting surface.

A variety of sawhorse brackets are manufactured, including those manufactured by Crawford Products, Inc., of West Hanover, Mass., which brackets receive pre-cut leg elements in receptacles on the lower surface thereof, and wherein, in some models, a gap is present between a portion of a cross-piece support and the cross-piece.

SUMMARY OF THE INVENTION

A workbench for use with a workpiece includes a work surface having multiple slots therethrough for securing the workpiece thereto; a pair of spaced apart frames attached to the work surface, wherein each frame includes a pair of legs and a brace structure; wherein the legs each have a groove extending along the length thereof, and which further includes a leg extension adjustably received in the groove for individually and infinitely adjusting the length of each leg.

An object of the invention is to provide a workbench that allows a user to attach a workpiece to a work surface using conventional attachment devices.

Another object of the invention is to allow work pieces to be attached to the bottom surface of the work surface.

A further object of the invention is to provide a workbench which includes an integrally formed leveling mechanism.

Still another object of the invention is to provide a workbench which may be compacted for easy transportation and shipping.

Yet another object of the invention is to provide a workbench which is inexpensive to manufacture and is durable.

These and other objects and advantages of the invention will become more fully apparent as the description which follows is read in conjunction with the drawings.

DETAILED DESCRIPTION OF THE PREFERRED EMBODIMENT

Figure 1:
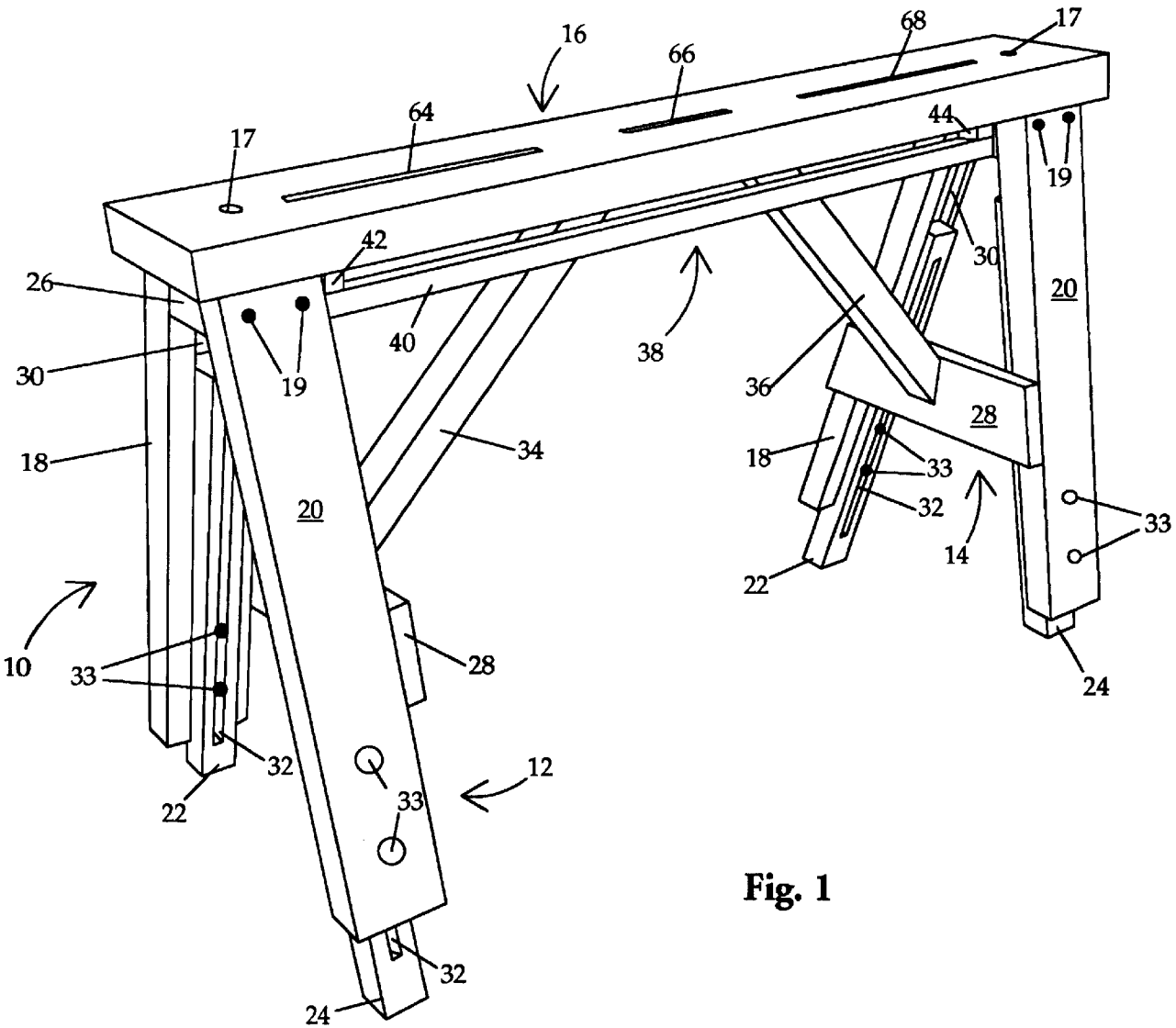
FIG. 1 is a perspective view of a workbench constructed according to the invention, with a shelf assembly thereof removed to show detail.
Figure 2:
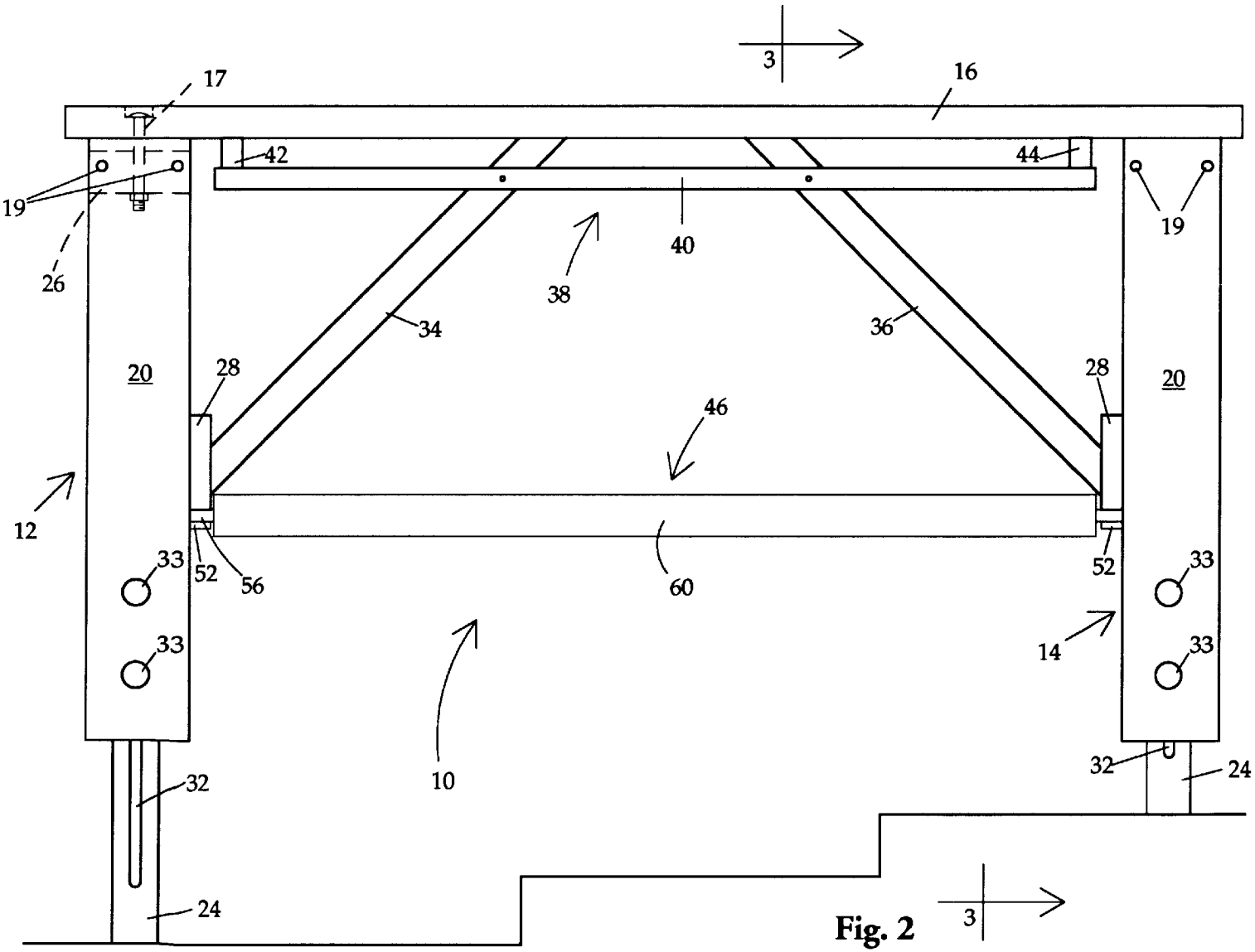
FIG. 2 is a side elevation of the workbench of FIG. 1, with one set of legs extended to conform to an uneven surface.
Figure 3:
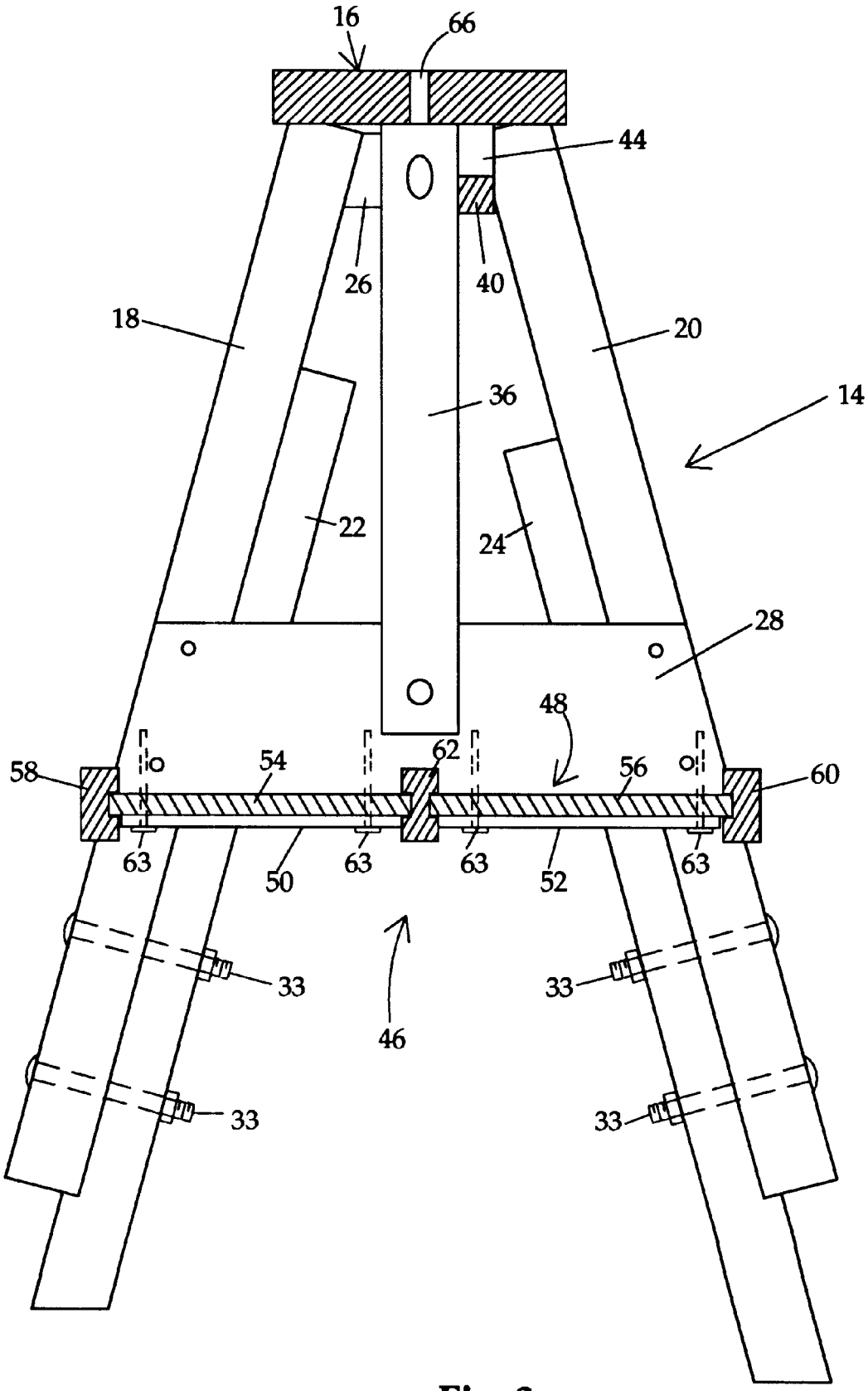
FIG. 3 is a median elevation taken generally along the line 3—3 of FIG. 1.

Turning initially to FIGS. 1 and 2, a workbench constructed according to the invention is depicted generally at 10. As previously noted, the workbench of the invention is adjustable to conform to uneven surfaces and accommodates a variety of workpiece holders.

Figure 4:
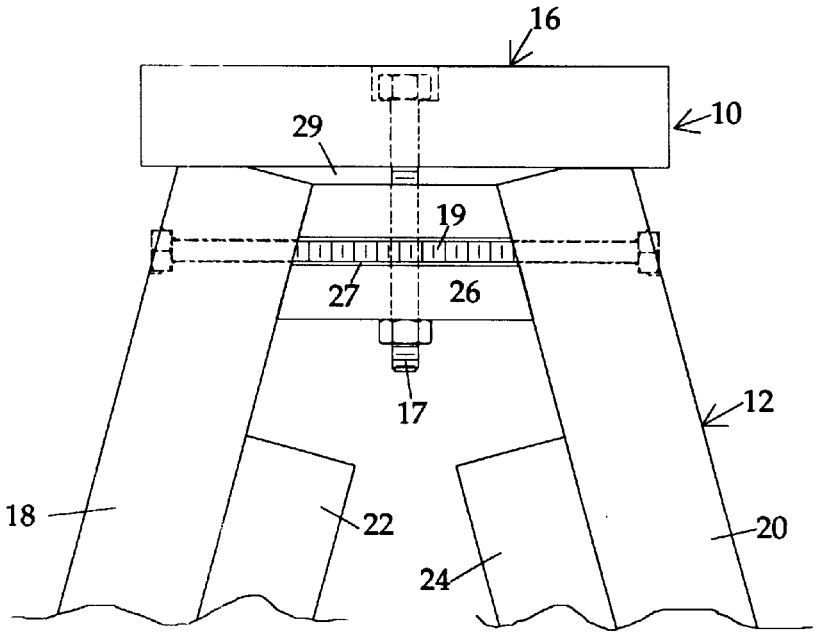
FIG. 4 is a partial end elevation of the workbench of FIG. 1, showing an upper brace in greater detail.

Workbench 10 includes two frames 12, 14, which support a work surface 16, also referred to herein as work surface member 16. Each frame includes two legs 18, 20, leg extensions 22, 24, an upper brace 26, and a lower brace 28. Legs 18, 20 of each frame are fixed at an optimum angle with respect to one another, such angle being between 24° and 44°, and joined by upper brace 26 and lower brace 28, collectively referred to herein as a brace structure. Upper brace 26 and legs 18, 20 may be fastened together by suitable fasteners 19, such as bolts with nuts, the pieces may be held together by adhesive, or the pieces may be integrally formed, as by molding. Where threaded fasteners are used, the nuts may lock into countersunk holes in the legs. Upper brace 26 may be formed as shown in FIG. 4, with a slot 27 on either vertical face to receive fastener 19 therein. Upper brace 26 has what is referred to herein as an inverted keystone configuration, and, in the preferred embodiment, is located slightly below the upper terminus of legs 18, 20, such that a gap 29 occurs between upper brace 26 and the lower surface of work surface 16. Lower brace 28 and legs 18, 20 may be fastened together with screws, or other suitable fasteners, or integrally formed.

Each leg has a groove 30 machined along the inside face thereof along the length thereof. A leg extension is received in each groove 30. Each leg extension includes a slot 32 machined therethrough along the length thereof. The extensions are free to slide along the length of the grooves in the legs. A fastening mechanism 33, such as bolts are placed through holes in the legs and pass also through the grooves in the extensions, and nuts, or wing nuts, attach to the bolts to fix the extension relative to the leg. The location of the bolts in the legs limit the amount each extension may slide relative to its associated leg, and also serve to fix the extension in place relative to its associated leg. In this way each leg is independently and infinitely adjustable, allowing workbench 10 to be used on all manner of uneven surfaces, such as stairs, hills, rough ground, broken floors, etc.

Work surface 16 is fixed to frames 12 and 14 by means of fasteners 17 which extend through fastening points in upper braces 26 and through work surface 16. Diagonally extending braces 34, 36 extend between work surface 16 and frames 12, 14, respectively, to provide further stability to workbench 10.

Figure 6:
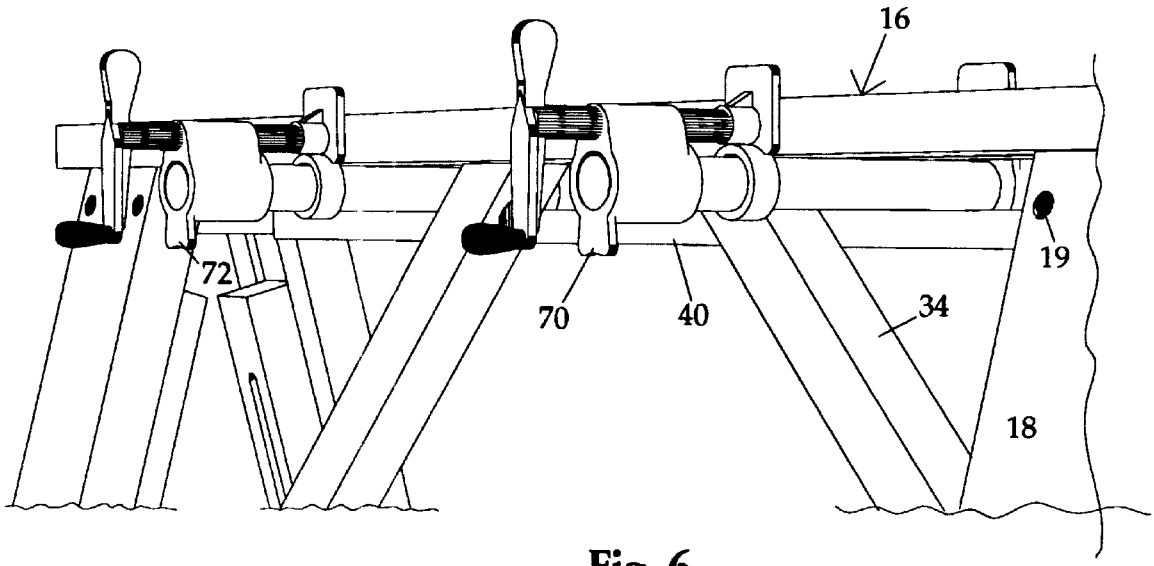
FIG. 6 is a perspective view of the workbench, taken from the lower left side thereof, in an environmental setting.
Figure 5:
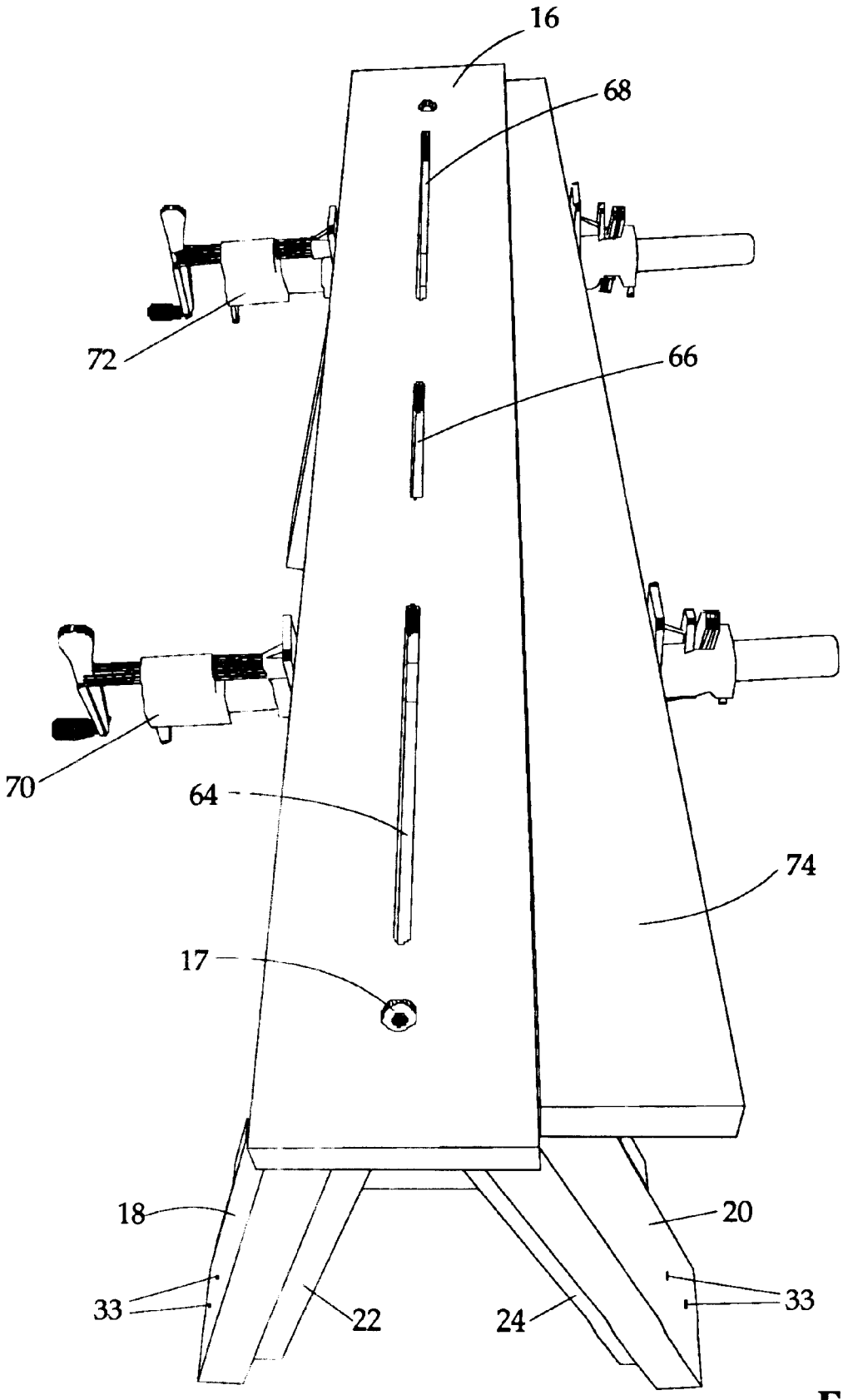
FIG. 5 is a perspective view of the workbench, taken from the upper left side thereof, in an environmental setting.

A bracket assembly 38 is located below work surface 16, and includes a transverse member 40, which is fixed to standoffs 42, 44, which are secured to the lower surface of work surface 16. Bracket assembly 38 is attached to the work surface 16 and to the diagonal braces. The distance between transverse member 40 and the bottom of work surface 16 is such as to facilitate the holding of standard pipe clamps, shown in FIGS. 5 and 6 at 70, 72, in position for use by the operator. In this way a clamping means is provided whereby the operator may temporarily attach a variety of items, such as workpiece 74, as shown in FIG. 5, to the edges of the top member to perform any number of operations on them.

A shelf assembly 46 includes a shelf 48, and mounting plates 50, 52, which are attached to the bottom edges of the lower braces 28. Shelf 48 includes two main shelf bottom elements 54, 56, two outer edge supports 58, 60, and a center divider 62. The pieces are assembled and attached to the bottom edges of the lower braces of the frames by screws or other attachment means 63. Center divider 62 defines a pair of compartments in shelf assembly 46. The construction of shelf assembly 46 provides extra strength, shelf compartments to separate stored items, and permits workbench 10 to be packaged in a smaller bundle for sale and shipping.

The top member may have a series of stopped slots machined therethrough, such as slots 64, 66 and 68, along the length thereof. These slots facilitate the attachment of a variety of items to the top member using common bolts and nuts, or other attachment means. Items such as bench machines, vises, table top accessories and other clamping means may be attached as may be other items, as determined by the user. Stops and forming jigs may be secured to work surface 16, as may be a variety of power tools.

In the preferred embodiment, workbench 10 is constructed with wood legs. The other components of the workbench may also be constructed of wood, metal, or molded or formed polymers. The selection of wood for the legs is the result of attempts to form or machine polymer material with grooves 30 and slots 32 formed in the legs: wood is simply the easiest material to be so formed.

Thus, a workbench which is portable, adjustable in height, able to compensate for uneven surfaces, capable of many different clamping alternatives, allows many items to be temporarily or permanently mounted to it, and with storage means for tools and other items has been disclosed. It is further capable of being manufactured economically and sold to a user at a reasonable price. Although a preferred embodiment of the workbench of the invention has been disclosed, it will be appreciated that further modifications and variations may be made thereof without departing from the scope of the invention as defined in the appended claims.

I claim:

1. A workbench for use with a workpiece comprising;

a work surface member having multiple elongate slots extending therethrough and therealong for securing the workpiece thereto;

a pair of spaced apart frames directly attached to said work surface member, wherein each frame includes a pair of legs and a brace structure; wherein said legs each have a groove extending along the length thereof providing an open channel on a side thereof, and which further includes a leg extension adjustably received in said groove for individually and infinitely adjusting the length of each leg; and a bracket assembly directly fixed to and extending below a lower surface of said work surface member said bracket assembly having two connectors spaced apart and attached to the lower surface of said work surface member, and a transverse member spaced apart from the lower surface of said work surface member and attached at ends thereof to said connectors.

2. The workbench of claim 1 which further includes a shelf assembly extending between said spaced apart frames.

3. The workbench of claim 2 wherein said shelf assembly includes at least one partition therein defining at least two compartments.

4. The workbench of claim 1 wherein said brace structure includes an upper brace and a lower brace, and wherein said upper brace extends between the upper terminus of said legs and has an inverted keystone configuration, including slots extending along opposed, vertical faces thereof for receiving fasteners for securing said legs to said upper brace, and which further includes a fastening point for securing said work surface member to said upper brace; wherein said upper brace is spaced below a lower surface of said work surface member forming a gap between said upper brace and said lower surface of said work surface member.

5. A workbench for use with a workpiece comprising;

a work surface member;

a pair of spaced apart frames directly attached to said work surface member, wherein each frame includes a pair of legs and a brace structure; wherein said legs each have a groove extending along the length thereof providing an open channel on a side thereof, and which further includes a leg extension adjustably received in said groove for individually and infinitely adjusting the length of each leg; and a bracket assembly directly fixed to and extending below a lower surface of said work surface member said bracket assembly having a plurality of connectors spaced apart and attached to the lower surface of said work surface member, and a transverse member spaced apart from the lower surface of said work surface member and attached to said connectors.

6. The workbench of claim 5 which further includes a shelf assembly extending between said spaced apart frames.

7. The workbench of claim 6 wherein said shelf assembly includes at least one partition therein defining at least two compartments.

8. The workbench of claim 5 wherein said brace structure includes an upper brace and a lower brace, and wherein said upper brace extends between the upper terminus of said legs and has an inverted keystone configuration, including slots extending along opposed, vertical faces thereof for receiving fasteners for securing said legs to said upper brace, and which further includes a fastening point for securing said work surface to said upper brace; wherein said upper brace is spaced below a lower surface of said work surface forming a gap between said upper brace and said lower surface of said work surface.

9. The workbench of claim 5 wherein said work surface member includes multiple elongate slots extending therethrough and therealong for securing the workpiece thereto.

* * * * *